US012553694B2

(12) United States Patent
Pedicini et al.

(10) Patent No.: US 12,553,694 B2
(45) Date of Patent: Feb. 17, 2026

(54) PROJECTILE CONSTRUCTION, LAUNCHER, AND LAUNCHER ACCESSORY

(71) Applicant: NL Enterprises, LLC, Cheyenne, WY (US)

(72) Inventors: Christopher Pedicini, Brentwood, TN (US); Joshua Pedicini, Nashville, TN (US)

(73) Assignee: NL ENTERPRISES, LLC, Cheyenne, WY (US)

( * ) Notice: Subject to any disclaimer, the term of this patent is extended or adjusted under 35 U.S.C. 154(b) by 49 days.

(21) Appl. No.: 18/468,844

(22) Filed: Sep. 18, 2023

(65) Prior Publication Data

US 2024/0230292 A1 Jul. 11, 2024

Related U.S. Application Data

(63) Continuation-in-part of application No. 17/319,295, filed on May 13, 2021, now Pat. No. 11,761,739.

(51) Int. Cl.
*F42B 6/00* (2006.01)

(52) U.S. Cl.
CPC ..... *F42B 6/006* (2013.01)

(58) Field of Classification Search
None
See application file for complete search history.

(56) References Cited

U.S. PATENT DOCUMENTS

2019/0120578 A1* 4/2019 Berger ..... F41A 1/04

FOREIGN PATENT DOCUMENTS

DE 102008064147 A1 * 7/2009 ..... F41A 21/32
WO WO-9932847 A1 * 7/1999 ..... F41A 21/32

* cited by examiner

*Primary Examiner* — Reginald S Tillman, Jr.
(74) *Attorney, Agent, or Firm* — XSENSUS LLP

(57) ABSTRACT

A launcher and projectile system include at least one permanent magnet disposed on or within the launcher for charging a wire coil of the projectile to energize an initiator of the projectile, thereafter having a housing of the projectile rupture, disintegrate, separate or otherwise have an opening created therein after launch to release a payload. In another embodiment, an accessory for a launcher and projectile is provided, the accessory comprising a permanent magnet for charging a projectile that is launched by the launcher.

6 Claims, 8 Drawing Sheets

PROJECTILE CONSTRUCTION, LAUNCHER, AND LAUNCHER ACCESSORY

CROSS-REFERENCE TO RELATED APPLICATIONS

The present disclosure is a continuation-in-part of and claims priority under 35 U.S.C. § 120 on pending U.S. Non-provisional application Ser. No. 17/319,295, filed on May 13, 2021, the disclosure of which is incorporated by reference.

FIELD OF THE DISCLOSURE

The present disclosure relates to non-lethal and lethal projectiles and related launching mechanisms and accessories and more specifically, to those projectiles with an initiator that may be activated during the launch phase of a launcher and/or a launcher accessory.

BACKGROUND OF THE DISCLOSURE

Non-lethal projectiles and non-lethal launching systems are commonly used by law enforcement for purposes of crowd control, such as quelling a riot or angry mob or to individually subdue a suspect. Increasingly, they may find usage as another means to augment self-defense in situations such as a home invasion, for example. The projectiles and systems (such as weapons that are capable of delivering such non-lethal projectiles) are designed to subdue a target subject or subjects for a time without causing permanent harm. Typically, such weapons systems require a projectile to burst on impact with the suspect and thus require accurate targeting and, in some cases, cause severe injury to a suspect. The most common means for such a device is a projectile that bursts on impact or a targeting device tethered by wires which delivers a high voltage shock thus immobilizing the suspect. All of these existing means suffer from a number of disadvantages outlined in more detail below.

The use of high voltage electric shock has been around for a number of years. While it is fairly effective at immobilizing a suspect, it suffers from the drawbacks that cardiac arrest in the target/suspect may result due to the voltage imparted into the suspect's body. Additionally, in the case of a suspect who is not in an open or unconstrained environment, such means requires accurate targeting to ensure that the electrodes contact the individual in order to deliver the electric shock. Furthermore, the longest effective range for such a device is less than 30 feet and more typically 10 or 15 feet. Additionally, the effectiveness of such weapons can be inhibited by clothing, coats or wet environments.

A second technique involves the use of a paintball that is filled with a *capsicum* or PAVA powder. While this eliminates or improves on the range issues of the electric shock techniques, it requires accurate targeting of the suspect. This is extremely difficult to do in short range as the ricochet of the powder off of a suspect can cause it to come back to the user. Furthermore, upon impact, the control of the powder release is not necessarily effective and can be one dimensional, meaning that it has difficulty stopping a suspect who is running away—as the cloud is left behind. Additionally, if the impact does not burst the projectile, the intended effect is not achieved.

Another approach is to provide for a projectile, the rupture or separation of which is caused by components that are powered by a battery or batteries that is/are internal to the projectile. However, in that batteries are inherently respectively large and heavy when compared to a projectile, and therefore limit the potential configurations of the projectile (due at least to the fact that the batteries occupy a substantial amount of space within the projectile). Furthermore, batteries are relatively expensive, thereby driving up the cost of manufacture of such a projectile. Furthermore, and quite concerningly, batteries drain and lose charge over time, which means that a projectile so configured may not be in a usable state for firing if it has been on the shelf for a length of time. This drawback is not acceptable, as the conditions under which such projectiles are to be used requires that they be ready to fire at all times.

Lethal projectiles have also been developed that fragment into multiple pieces, thus increasing the effective radius of such a projectile (and lowering the requisite targeting precision). Such fragmentation may be caused by components that are powered by a battery or batteries that is/are internal to the projectile or by the actual impact on the target. However, in that batteries are inherently respectively large and heavy when compared to a projectile, and therefore limit the potential configurations of the projectile (due at least to the fact that the batteries occupy a substantial amount of space within the projectile). Furthermore, batteries are relatively expensive, thereby driving up the cost of manufacture of such a projectile. Again, batteries drain and lose charge over time, which means that a projectile so configured may not be in a usable state for firing if it has been on the shelf for a length of time. This drawback is not acceptable, as the conditions under which such projectiles are to be used requires that they be ready to fire at all times.

All of the currently available methods for non-lethal projectiles suffer from one or more of the following disadvantages: difficult to target, not suitable for close range, not suitable for long range, inaccurate, sometimes lethal and often otherwise not effective, costly to manufacture, complex in configuration, and not reliably powered. Furthermore, with regard to lethal projectiles, most currently available methods drawbacks the requirement that such a projectile must impact the target to be effective and heavy and complex battery arrangements for power and operation.

SUMMARY OF THE DISCLOSURE

In view of the foregoing disadvantages inherent in the prior art, the general purpose of the present disclosure is to provide a projectile construction (also referred to herein as "projectile" in context), projectile launcher, and launcher accessory that include all the advantages of the prior art, and overcomes the drawbacks inherent therein. As used herein, "payload" may refer to a substance, object, compound, or material that is capable of delivering a lethal or incapacitating force to and/or resulting in a lethal or incapacitating effect upon a target. Such a payload can be in powder, liquid or aerosol, or foam form and/or in the form of shrapnel (or a combination thereof) without departing from the spirit of the disclosure. The payload may comprise a debilitating material, a visible substance (such as a dye or a powder, for example) or an invisible marking substance (such as a UV-reactive material, for example) or a combination thereof.

In an embodiment, a launcher comprises at least one permanent magnet (hereinafter "magnet" as used throughout shall mean a permanent magnet unless particularly specified otherwise). The at least one magnet may be disposed within or in proximity to the barrel of the launcher, and in a further embodiment, proximate to the point of projectile exit, and in any event along the launch axis of the projectile. (See FIG.

1, for example). The at least one magnet is preferably magnetically-aligned with the launch axis. In an embodiment, the projectile comprises at least one coil of wire. When the projectile is launched, the at least one magnet of the launcher causes a rapid change in magnetic flux of coil of the moving projectile as it moves along the launch axis. This rapid change causes a current to be induced through the coil of the projectile, causing an inductive energy to be produced. In this way, it is understood that the at least one magnet of the launcher is capable of providing energy to the projectile. Those familiar in the art will recognize this as Faraday's Law of Induction $$\left(\varepsilon = -N\frac{d\Phi_B}{dt}\right).$$

That is, electrical energy can be generated thereby from the change in magnetic flux as the projectile moves through the magnetic field caused by the at least one magnet of the launcher. As used herein, this inductive method may be referred to as "inductive activation" when it refers to activating a circuit and/or initiator of the projectile.

In another embodiment, an accessory for a launcher comprises at least one magnet. The accessory is configured to be removably attached to a launcher, and in an embodiment, to the barrel of a launcher. The at least one magnet of the accessory may be disposed within or in proximity to the barrel of the launcher, and along the launch axis of the projectile. (See FIG. 7, for example). The at least one magnet is preferably magnetically-aligned with the launch axis. As used herein, magnetic alignment comprises the creation of magnetic flux lines in the barrel or accessory such that a coil moving through the barrel or accessory receives an induced electrical charge. In an embodiment, the projectile comprises at least one coil of wire. When the projectile is launched, the at least one magnet of the launcher accessory causes a rapid change in magnetic flux of coil of the moving projectile as it moves along the launch axis. This rapid change causes a current to be induced through the coil of the projectile, causing an inductive energy to be produced. In this way, it is understood that the at least one magnet of the launcher accessory is capable of activating a circuit or an initiator of a projectile.

In an embodiment, the projectile separates into two or more components on exit from the barrel of a launcher to distribute a payload. In an embodiment, the separation can be initiated by electrical, mechanical or chemical means or by a combination thereof.

In another embodiment, an initiator may be disposed within the projectile. The initiator may either initiate a chemical reaction or otherwise cause a separation of the projectile through a mechanical or electromechanical method. The initiator and reaction can be initiated when current has been induced in the coil of wire of the projectile by the at least one magnet. In an embodiment, the initiator comprises an electric match, a nichrome wire coupled with a mechanical energy storage device (such as a spring), or a resistive heating filament. In an embodiment, the nichrome wire, when activated may cause the spring to expand to rupture the projectile.

In a still further embodiment in which the separation, opening, etc. of the projectiles is a result of a chemical reaction, an activating compound such as nitrocellulose may be initiated with the electric match, for example. The electric match may consist of a nichrome or similar high resistance wire that is coated with a pyrogen. In an embodiment, wherein the launcher and/or launcher accessory comprises at least one magnet, when the projectile is launched, the at least one magnet of the launcher and/or accessory can activate the electric match by inductive activation.

DESCRIPTION OF THE DRAWINGS

The advantages and features of the present disclosure will become better understood with reference to the following detailed description and claims taken in conjunction with the accompanying drawings, wherein like elements are identified with like symbols, and in which:

DETAILED DESCRIPTION OF THE DISCLOSURE

The exemplary embodiments described herein detail for illustrative purposes are subject to many variations in structure and design. It should be emphasized, however, that the present disclosure is not limited to a particular projectile or projectile launcher as shown and described. That is, it is understood that various omissions and substitutions of equivalents are contemplated as circumstances may suggest or render expedient, but these are intended to cover the application or implementation without departing from the spirit or scope of the claims of the present disclosure. The terms "first," "second," and the like, herein do not denote any order, quantity, or importance, but rather are used to distinguish one element from another, and the terms "a" and "an" herein do not denote a limitation of quantity, but rather denote the presence of at least one of the referenced item.

The present disclosure provides for a projectile 100 and a launcher 1000, and, in an embodiment, a launcher accessory 1100. The projectile 100 preferably comprises a payload 200 for immobilizing and/or marking a target or suspect. It will be understood that payload as used herein may also comprise a substance, object, compound, or material that is capable of delivering a lethal or incapacitating force to and/or resulting in a lethal or incapacitating effect upon a target The projectile 100 preferably comprises an enclosure, which enclosure may be formed by an at least partially annular-shaped shell 102. The shell may include a closed, substantially planar end portion 104 (also referred to herein as "end cap") that corresponds to a radius of the annular portion of the shell to form the enclosure. The shell and end portion may individually and collectively refer to herein as a housing of projectile 100. It will be apparent that the projectile housing is not limited to the shell and end portion configuration mentioned in the preceding exemplary embodiment, and that the projectile housing may comprise any shape that forms an enclosure without deviating from the spirit of the disclosure, such as, but not necessarily limited to a sphere or a cone. The payload 200 is preferably contained in the enclosure prior to launch of the projectile 100.

In an embodiment, the projectile 100 is capable of self-separating, disintegrating or otherwise opening prior to impact with a target or other impact surface. In an embodiment, the launcher 1000 is capable of initiating separation or disintegration or rupturing or opening, etc. of the projectile 100. In an embodiment, the launcher 1000 is capable of communicating to the projectile 100 and or arming a projectile 100 prior to or coincident with projectile launch. In another embodiment, the launcher comprises a safety and/or trigger, which safety and/or trigger, until activated, prevent the projectile from becoming armed. The arming can be, for example, the activation of an initiator contained within the projectile.

Figure 1:
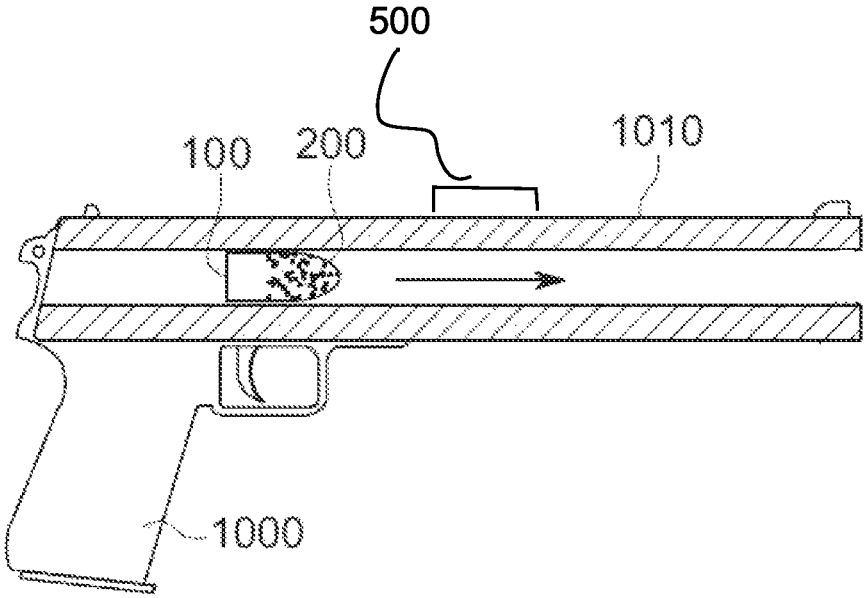
FIG. 1 is a longitudinal cross-sectional view of a projectile launcher 1000 with a projectile, according to an exemplary embodiment of the present disclosure.
Figure 1A:
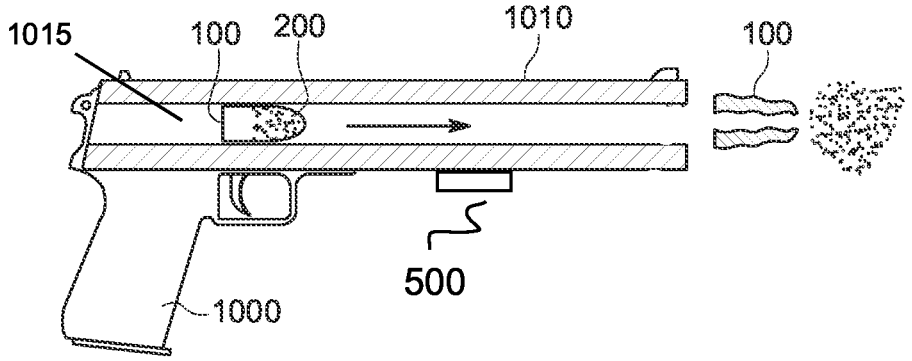
FIG. 1A is a view of the barrel of a projectile launcher and at least one magnet of the launcher.

In another embodiment and as shown in FIG. 1A, the launcher comprises at least one permanent magnet 500. The at least one magnet 500 may be disposed within or in proximity to the barrel of the launcher, and in a further embodiment, proximate to the point of projectile exit, and in any event along the launch axis of the projectile. (See FIG. 1, for example). The at least one magnet 500 is preferably magnetically-aligned with the launch axis. In a further embodiment, a launcher accessory 1100 comprises at least one permanent magnet 1500 (see FIG. 7, for example). The launcher accessory may be removably attachable to a launcher 1000, and the at least one magnet 1500 of the accessory may be disposed along the launch axis of the projectile that is to be launched by the launcher.

Figure 6:
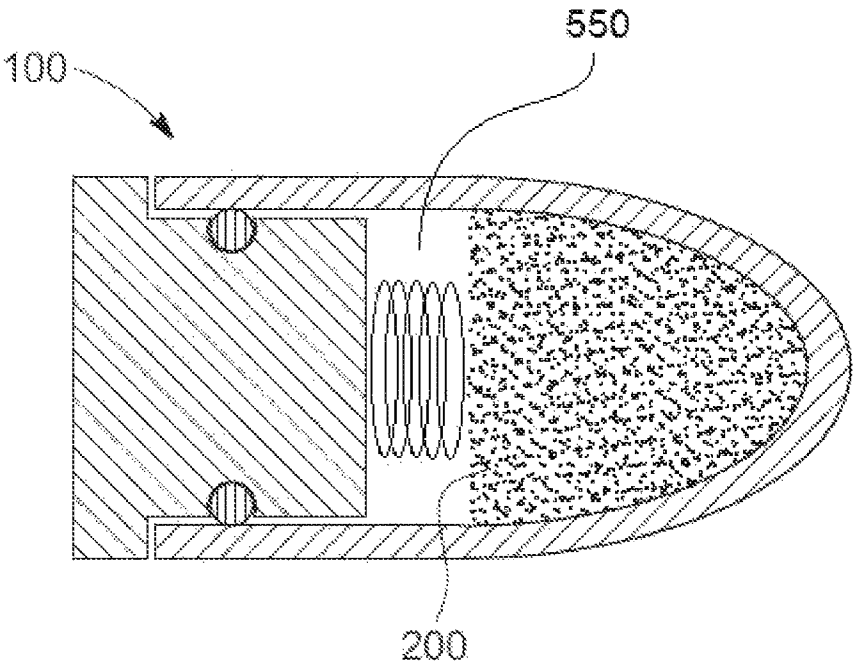
FIG. 6 shows a cross-sectional view of a projectile comprising a coil of conductive wire in accordance with an exemplary embodiment of the present disclosure.

In an embodiment, and as shown in an exemplary embodiment in FIG. 6, the projectile comprises at least one coil of wire 550. When the projectile is launched, the at least one magnet 500 of the launcher and/or the at least one magnet 1500 of the launcher accessory 1100 causes a rapid change in magnetic flux of coil 550 of the moving projectile. This rapid change causes a current to be induced through the coil 550 of the projectile, causing an inductive energy to be produced. The resultant energy can be used to cause an initiator (described elsewhere herein) to be activated, for example. That is, electrical energy can be generated in this embodiment from the change in magnetic flux as the projectile moves through the magnetic field caused by the at least one magnet 500 and/or 1500.

An exemplary launcher 1000 is shown in FIG. 1A. The launcher comprises a barrel 1010 for directing and launching a projectile 100. The launcher 1000 may also comprise a chamber 1015 for holding a projectile prior to firing thereof. It will be apparent that the launcher 1000 shown in FIG. 1*a* may be in other configurations so long as the launcher 1000 is capable of firing a projectile 100 of the projectiles disclosed herein.

Figure 2:
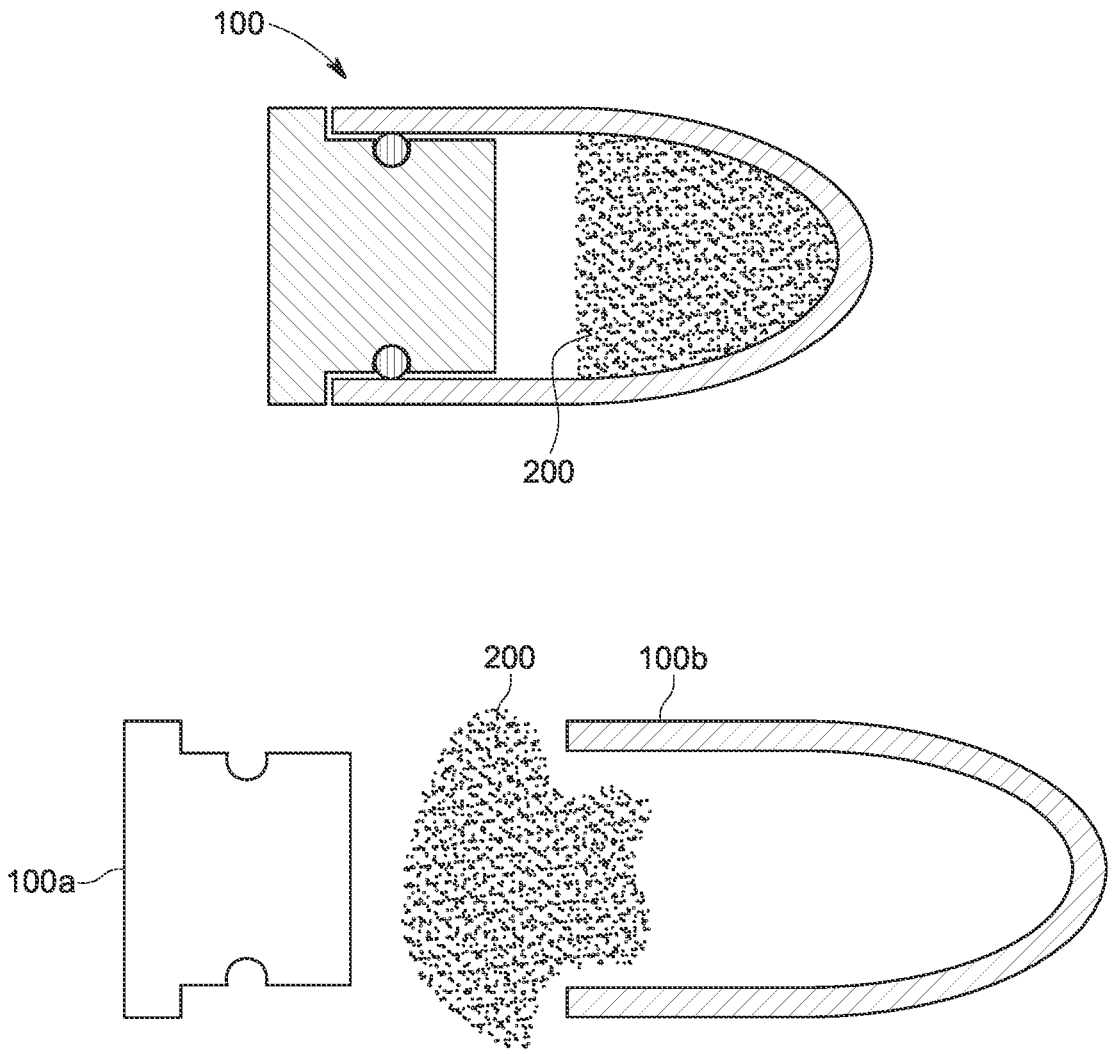
FIG. 2 are views of a projectile both before launch and then during flight in which the housing of the projectile has separated and released a payload, in accordance with an exemplary embodiment of the present disclosure.

In an embodiment, the projectile 100 housing opens or otherwise separates (as shown in FIG. 2 as 100*a* and 100*b*) after it leaves the barrel 1010 of a launcher 1000 to distribute a payload. That is, the rupturing or breaching of the projectile housing or the separation of housing components creates an opening in the projectile 100 out of which the payload 200 may emanate.

Figure 3:
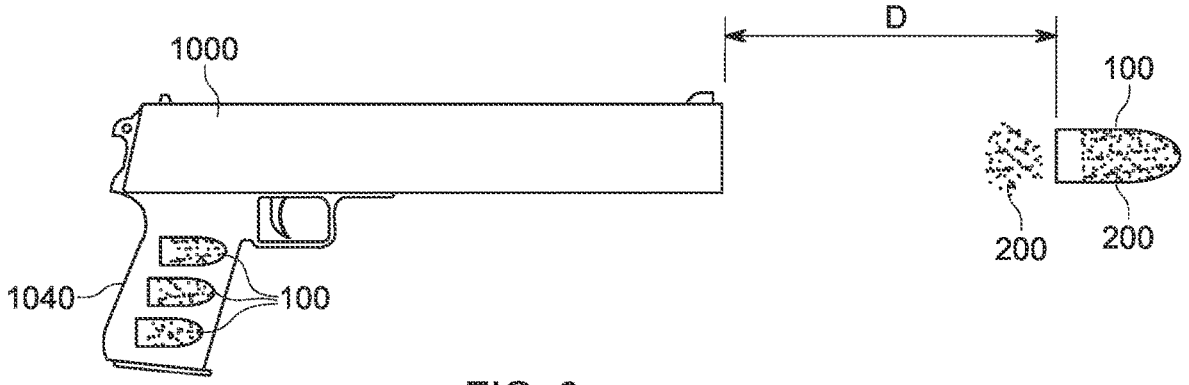
FIG. 3 is a view of a projectile launcher with a magazine, in accordance with an exemplary embodiment of the present disclosure.

As shown in FIG. 3, the launcher and projectile system may comprise a magazine 1040 that holds a plurality of projectiles 100 and that feeds said projectiles 100 to the launcher 1000 for firing/launching the projectiles 100.

Figure 4:
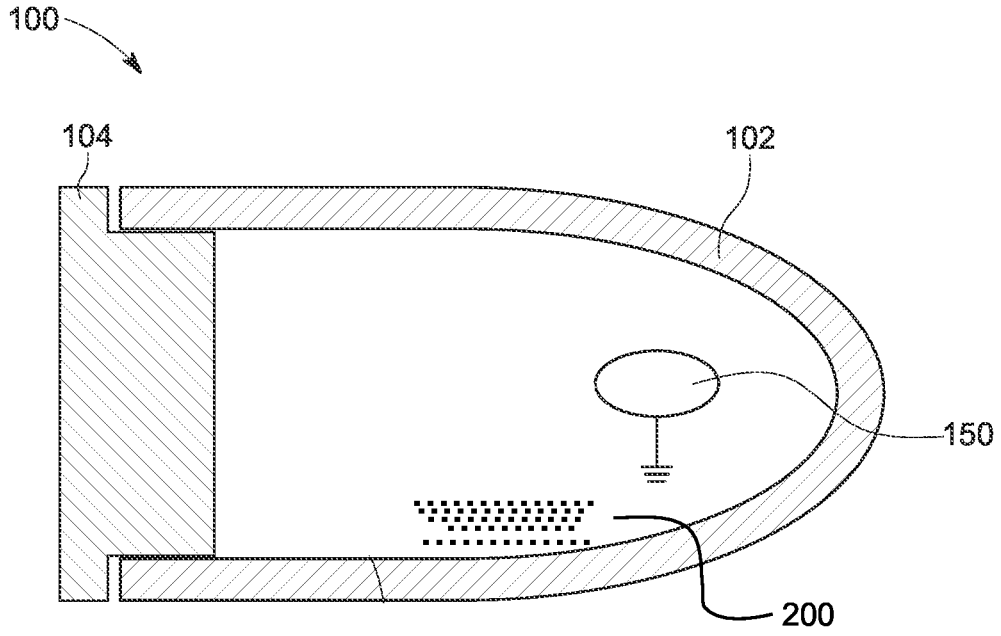
FIG. 4 is a view of a projectile comprising a payload and an initiator, in accordance with an exemplary embodiment of the present disclosure.

In an embodiment, and as shown in FIG. 4, the initiator 150 may be an electric match, which electric match may heat upon activation to create an opening in the shell of the projectile 100 to release the payload 200. It will be apparent that the initiator may be activated by the at least one magnet 500 of the launcher and/or the at least one magnet 1500 of the launcher accessory. In said embodiment, the initiator will initiate opening of the projectile immediately or shortly after exiting the launcher. This would be desirable in a short-range situation, for example.

In another embodiment, the initiator 150 comprises a resistive heating element, which may element becomes heated upon receiving energy from the coil 550 of wire of the projectile 100. The element, in its heated state, preferably causes the shell of the projectile 100 to degrade and rupture to release the payload.

In another embodiment, the initiator 150 comprises a nichrome wire coupled with a mechanical energy storage means (such as a spring). In this configuration, the mechanical energy storage means may be disposed within the projectile 100 such that it is biased against the shell 102. When the projectile is launched, the energy from the coil 550 of wire (generated by the movement of the projectile 150 through the magnetic field caused by the at least one magnet 500 and/or 1500) may cause the nichrome wire to heat such that the heat may cause the shell 102 to weaken and/or melt. In the weakened state, the potential energy of the mechanical energy storage may be converted to kinetic energy to cause the weakened shell 102 to rupture sch that the payload is released.

In an embodiment, activation of the initiator 150 does not occur until the projectile 100 reaches a threshold velocity. In an embodiment, the threshold velocity is between 50 and 300 feet per second. In such an embodiment, the initiator is configured not to activate until a threshold minimum current is reached. As the induced voltage in a coil of wire 550 is directly proportional to change in magnetic flux divided by the change in time, if the change in time is lower (i.e. the projectile 100 passes through the magnetic field lines of the permanent magnet at a higher velocity), a higher voltage in the projectile coil 550 will be induced and hence a higher current will be moved through the coil 550 to the initiator 150. Therefore, the projectile 100 must be traveling with sufficient threshold velocity to induce this threshold current value for activation of the initiator 150.

Figure 5:
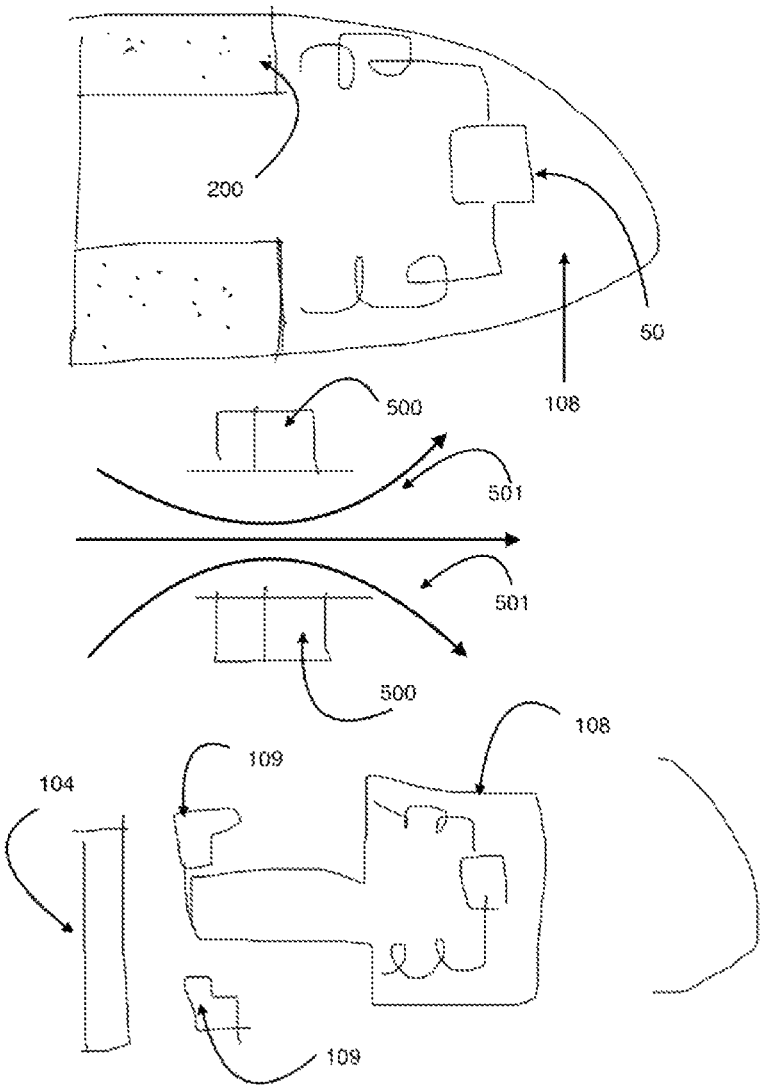
FIG. 5 shows a projectile with a ram, in accordance with an exemplary embodiment of the present disclosure.

In another embodiment, and as shown in FIG. 5, the projectile 100 may comprise a ram 108. The ram 108 is movable within the housing of the projectile such that when the initiator 150 (such as an electric match) activates, the ram 108 is moved by the force activation. In an embodiment, the ram 108 is proximate to a portion of the interior of the shell 102 such that the movement of the ram 108 caused by the initiator contacts and causes the shell to separate, rupture, open, etc. such that the payload may be released from the shell. In such an embodiment, the payload may also be proximate to the region of the shell 102 that is contacted by the ram 108 and/or that is opened by the ram 108. An exemplary opening of the projectile is shown in FIG. 5 in which a moving projectile 100 has disrupted the static field lines 501 (being generated by a magnetic element/s 500) to activate the initiator 150, which accelerates the ram 108, such that the end cap 104 is ejected, and the payload 200 is thereafter dispersed. Stoppers 109 may be provided to ensure that the ram 108 does not eject with the payload 200 and end cap 104.

Figure 7:
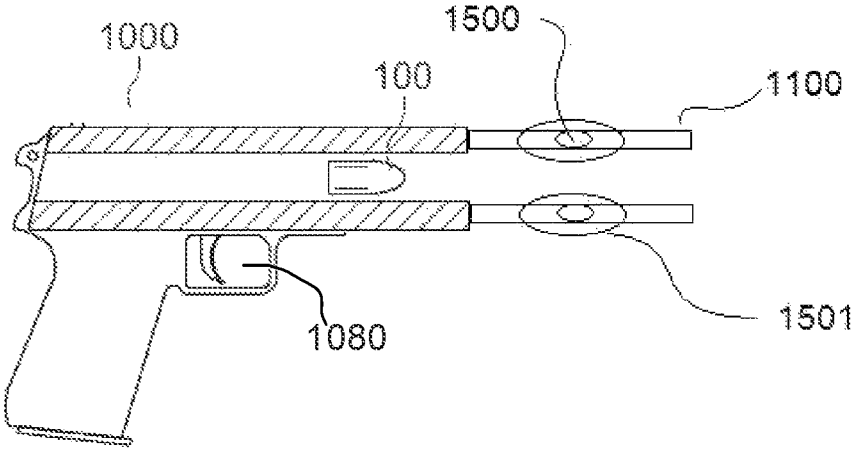
FIG. 7 shows a projectile, launcher, launcher trigger and a launcher accessory, the accessory comprising at least one magnet which magnetic field lines are shown in accordance with an exemplary embodiment of the present disclosure.

Referring now to FIG. 7, a launcher accessory 1100 for a launcher is shown. The launcher accessory 1100 comprises at least one magnet 1500. The launcher accessory 1100 may be removably attached to a launcher (including, but not necessarily limited to launcher 1000). The accessory 1100 is preferably attached to a launcher such that the at least one magnet 1500 of the accessory 1100 is disposed in sufficient proximity to the launch axis of the launcher to facilitate launch of the projectile 100 and to engage the coil of wire 550 of the projectile 100 prior to or coincident with launch of the projectile. FIG. 7 also shows exemplary magnetic flux lines 1501 through which a projectile may pass and which may engage the coil of wire 550 of the projectile. In this exemplary embodiment, the magnetic flux 1501 is disposed along the launch axis of the accessory 1100 and is accordingly magnetically aligned with path of the projectile's launch. In an embodiment, the accessory 1100 is an elongated cylinder in shape, with a circumference that corresponds to the circumference of the barrel of the launcher to which the accessory 1100 is attached. Attachment of the accessory 1100 to the launcher 1000 may be by way of complementary engagement features, by a friction- or press-fit engagement, or by threaded connection, for example.

As shown in FIG. 7, the launcher 1000 may comprise a trigger 1080 to initiate the launch process. It will be apparent that the activation of the initiator by the launcher and/or launcher accessory eliminates the requirement that the projectile comprise a self-contained power source (i.e., a battery for the projectile is not required), thereby eliminating the possibility that the projectile will suffer a power drain prior to launch.

FIG. 1 represents a projectile launcher 1000 that is preferably based on electrical-driven or a combination of electrical and combustion or compressed gas means. It is understood that the projectile is not limited to a particular launching method. In an embodiment, the projectile herein is of lightweight construction (for at least the reason that it does not require an internal battery), such that compressed gas can sufficiently and effectively launch the projectile. However, the disclosure may, in other embodiments include, a primer and/or propellant on the projectile and a hammer of the launcher to strike such primer, as well as other means of launching the projectile other than by way of compressed gas.

The projectile, launcher, and launcher accessory disclosed herein offer the advantages of more controlled release of payload than existing solutions can offer. The projectile further does not require impact upon a target. Configuration of the shell of the projectile disclosed herein may also increase accuracy of flight of the projectile to further improve the safety of use of the projectile disclosed herein. Furthermore, the projectile can be kept in an unarmed state until the projectile is launched from the launcher.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The exemplary embodiment was chosen and described in order to best explain the principles of the present disclosure and its practical application, to thereby enable others skilled in the art to best utilize the disclosure and various embodiments with various modifications as are suited to the particular use contemplated.

What is claimed is:

1. A projectile and launcher system, said launcher comprising a launch axis and at least one permanent magnet, said projectile comprising a housing, a payload, a conductive wire coil, a moveable ram and an initiator, wherein said at least one permanent magnet is magnetically aligned with said launch axis such that it induces a current in the conductive wire coil of the projectile during launch of said projectile, wherein said initiator is activated by said current, and wherein said activated initiator causes said projectile housing to rupture, disintegrate, separate or otherwise have an opening created therein after launch and release said payload.

2. The system of claim 1, wherein said initiator consists of at least one of an electric match, a nichrome wire operatively coupled to a spring, and a resistive heating element.

3. The system of claim 1, wherein said activation of said initiator does not occur unless the velocity of said projectile reaches a threshold level.

4. An accessory for a launcher for removable attachment to a projectile launcher of a projectile, which projectile comprises a coil of wire, an initiator, a moveable ram, and a payload, said accessory for a launcher capable of removable attachment with said launcher, said launcher comprising a launch axis, said accessory for a launcher comprising a launch axis, and at least one permanent magnet, wherein said launch axis of said accessory for a launcher is physically aligned with said launch axis of said launcher to facilitate launch of the projectile, wherein said at least one permanent magnet of said accessory for a launcher is magnetically aligned with said launch axis of said launcher such that said magnet may induce a current in the conductive wire coil of the projectile during launch of said projectile, wherein said initiator of said projectile is activated by said current, and wherein said activated initiator causes said projectile housing to rupture, disintegrate, separate or otherwise have an opening created therein after launch and release a payload.

5. The accessory of claim 4, wherein said initiator consists of at least one of an electric match, a nichrome wire operatively coupled to a spring, and a resistive heating element.

6. The accessory of claim 4, wherein said activation of said initiator does not occur unless the velocity of said projectile reaches a threshold level.

* * * * *